United States Patent [19]

McGlew et al.

[11] 4,175,300

[45] Nov. 27, 1979

[54] PAINT ROLLER CONSTRUCTION

[76] Inventors: John J. McGlew; John J. McGlew, Jr., both of 432 Terrace Ave., Hasbrouck Heights, N.J. 07604

[21] Appl. No.: 874,508

[22] Filed: Feb. 2, 1978

Related U.S. Application Data

[63] Continuation of Ser. No. 684,728, May 10, 1976, abandoned.

[51] Int. Cl.[2] ..... B05C 1/00

[52] U.S. Cl. ..... 15/103.5; 15/24; 401/197; 401/204; 401/205

[58] Field of Search ..... 401/197, 204, 205; 15/24, 97 R, 98, 103.5

[56] References Cited

U.S. PATENT DOCUMENTS

| | | | |
|---|---|---|---|
| 2,606,334 | 8/1952 | Vaden et al. | 401/197 |
| 2,892,439 | 6/1959 | Dynia | 15/98 X |
| 3,321,795 | 5/1967 | Richardson | 401/197 |
| 3,539,268 | 11/1970 | Stebbins | 401/197 |
| 3,551,934 | 1/1971 | Franzreb | 15/97 R |
| 3,724,016 | 4/1973 | Soffer | 15/98 |
| 3,879,140 | 4/1975 | Ritter | 401/197 X |

FOREIGN PATENT DOCUMENTS

| | | | |
|---|---|---|---|
| 822859 | 9/1969 | Canada | 401/197 |
| 1035235 | 4/1953 | France | 401/197 |

*Primary Examiner*—Edward L. Roberts

*Attorney, Agent, or Firm*—McGlew and Tuttle

[57] ABSTRACT

A paint roller construction comprises a roller which is supported on a support which has a handle. The support carries an electric drive motor for a pump which supplies a paint through a connecting conduit in the support directly into the roller. The interior of the roller is maintained at a predetermined pressure in order that the paint may be delivered outwardly through the pores of the roller applicator surface at a controlled rate for application on a surface. The device also advantageously includes a drive motor which may be operated at a selected speed in order to rotate the roller at an amount which is comparable to the pressure of the paint supply so as to apply the paint at a predetermined application rate and thickness. In one embodiment the drive motor is carried on an end bracket of the paint roller support and directly drives the roller either electrically or by the fluid action of the paint which is delivered to the roller and preferably the drive of the roller is variable as is the supply of the paint in order to provide a complete control for the paint application. In another embodiment the paint is contained in the handle for the paint roller and it is supplied at a controlled rate to one or more sections of the roller in order to vary the application amount along the length of the roller and it is applied at a rate comparable to the rate of rotation of the roller. The roller itself may contain both the paint supply and pump as well as the motor for driving the roller during application.

24 Claims, 10 Drawing Figures

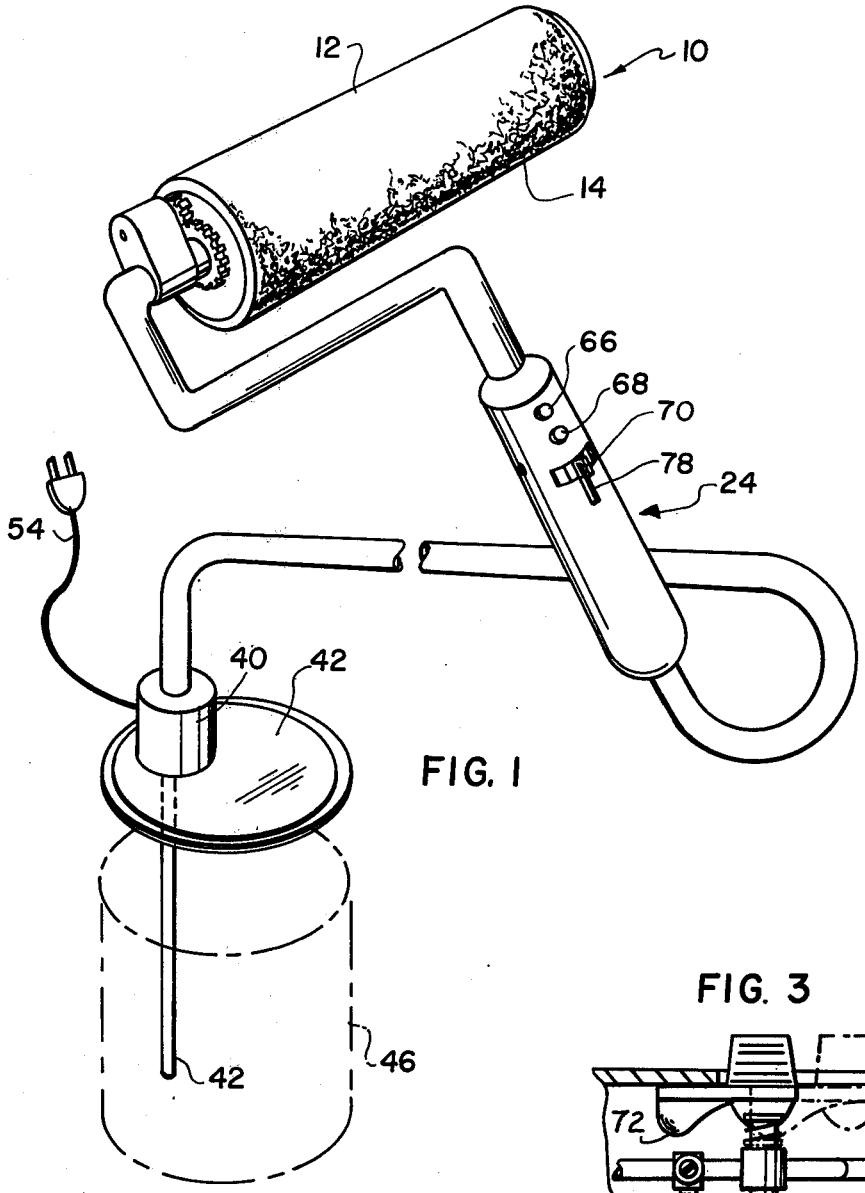
FIG. 1
FIG. 3
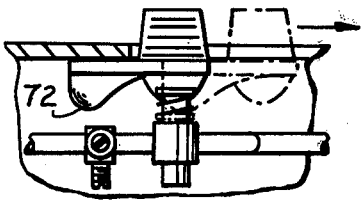
FIG. 5
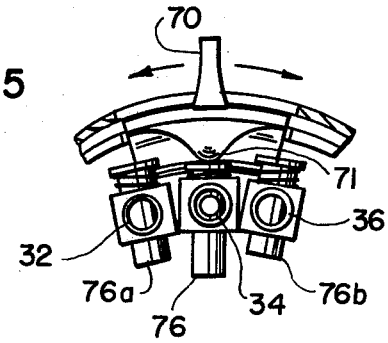
FIG. 4
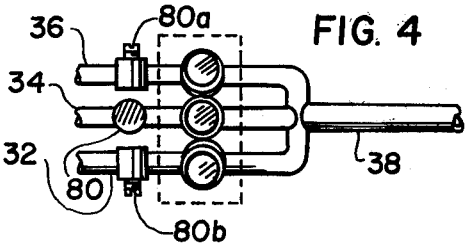

FIG. 2
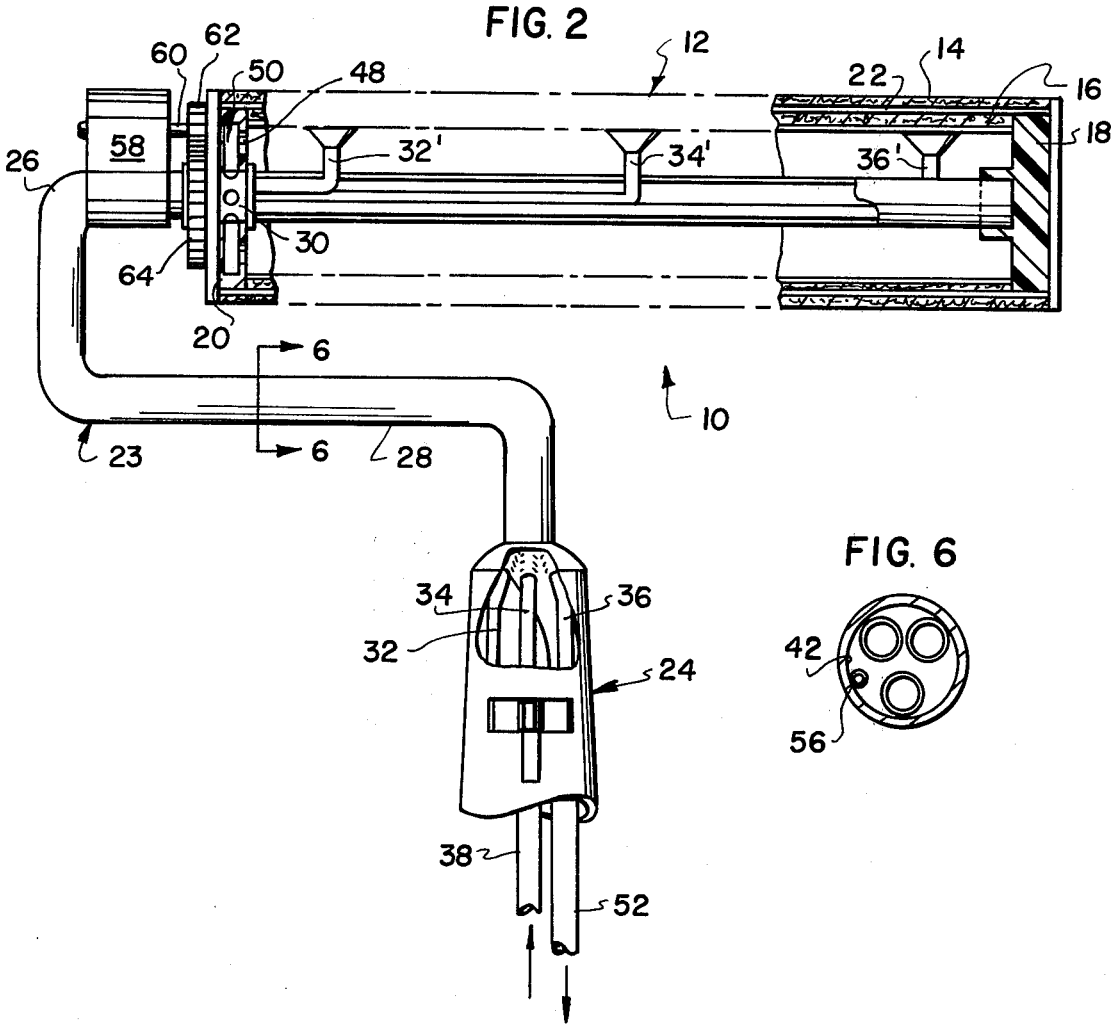
FIG. 6
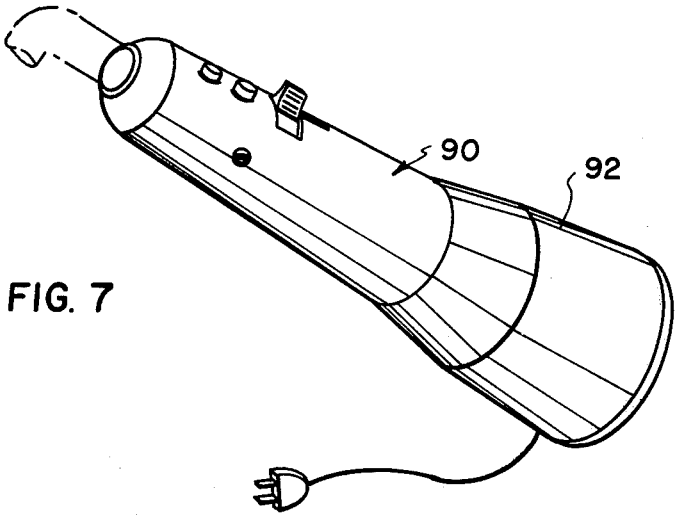
FIG. 7

FIG. 8
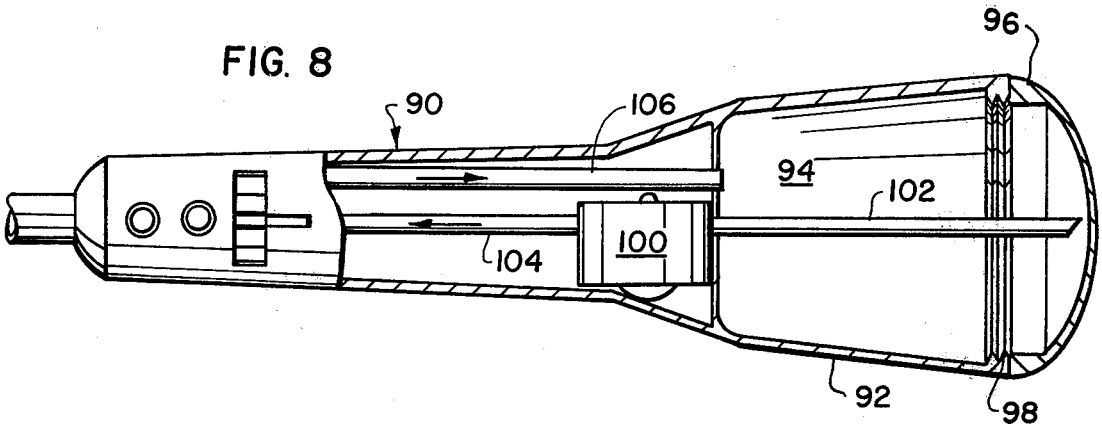
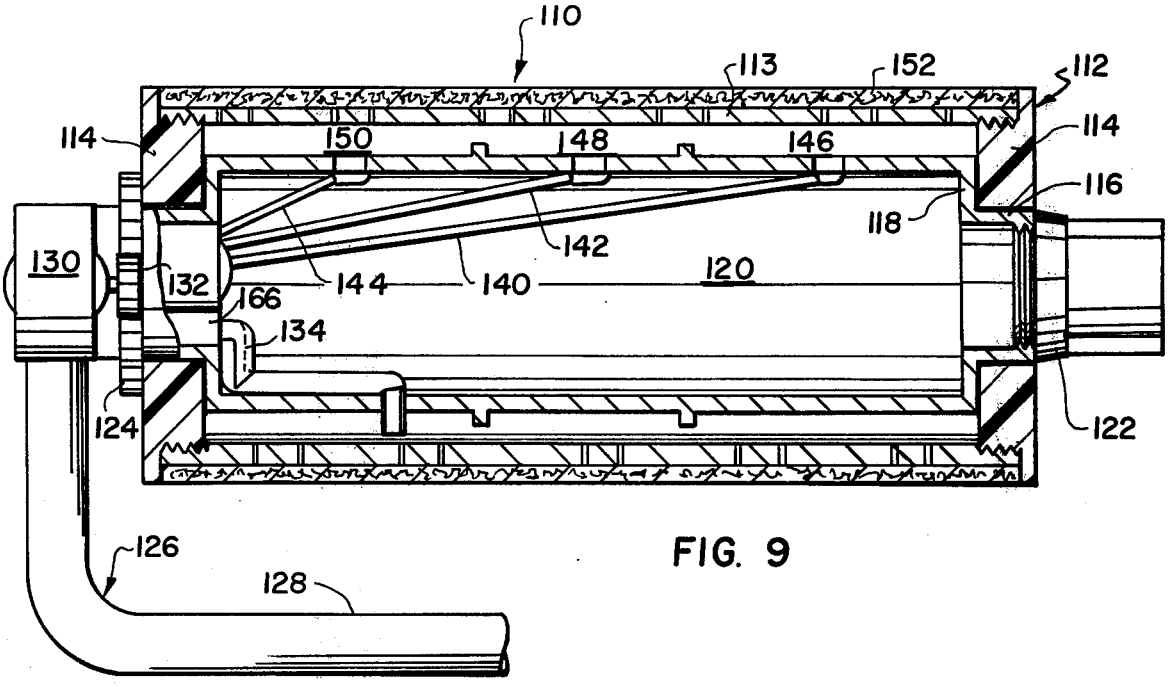
FIG. 9
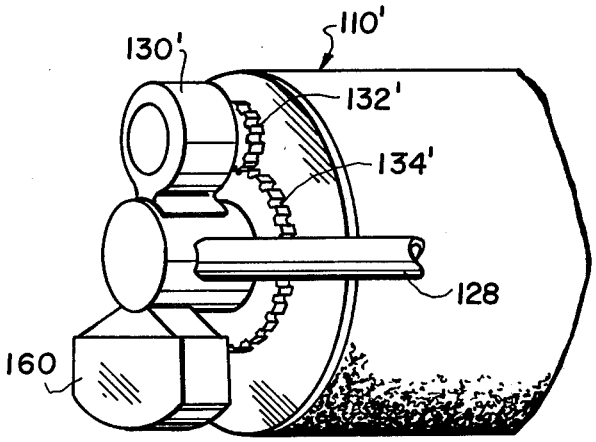
FIG. 10

PAINT ROLLER CONSTRUCTION

This is a continuation of application Ser. No. 684,728 filed May 10, 1976 now abandoned.

BACKGROUND OF THE INVENTION

1. Field of the Invention

This invention relates in general to the construction of liquid applicators and in particular to a new and useful paint roller construction in which the paint is suppled to the roller under pressure so that it will flow outwardly through the pore surface of the roller at a controlled rate in which the roller is advantageously rotated at a rate comparable to the supply rate of the paint.

2. Description of the Prior Art

At the present time paint rollers are known which comprise rollers which rotate on a handle support and which are dipped into the paint supply which must be contained in a shallow depth pan for this purpose. The paint is then applied usually heavy upon the first application when the initial coating of the paint over the surface of the roller is applied and it is moved around until all of the paint works out of the surface of the roller and onto the receiving surface. A difficulty in such an arrangement is that the paint is not always applied uniformly and it usually is difficult to work the paint out of all of the receiving pores of the exterior surface of the roller during the application.

SUMMARY OF THE INVENTION

In accordance with the present invention a liquid or paint applicator includes a roller which is rotatably supported on a hand support and the paint is delivered to the interior of the roller and forced under pressure outwardly through the porous walls of the roller at a controlled rate which would depend on the application rate. In the preferred form the surface is also moved that is rotated at a rate comparable to the rate at which the paint is to be applied. With the ideal situation both the paint rate and the roller movement rate are controlled to effect the uniformity of painting which is determined afer a few experimental applications. The device may also be used for special painting effects by pressurizing one section of the roller to a greater or lesser degree than another or by varying the speed of rotation of the roller so as to vary the transfer effect of the action of the paint on the wall surfaces.

In one embodiment of the roller it comprises a handle having a conduit defined therethrough for the passage of paint from a paint can directly through the handle and through the support for the roller and into a side of the roller. The roller is made of an outer wall which is porous and the paint is moved outwardly under pressure through the pores to the surface of the roller in a continuous rate for application to the surface. In the preferred form the pump motor advantageously is incorporated on a paint can lid which may be replaced on an ordinary paint can during operation and so as to position a suction for the pump downwardly into the paint can. The supply of paint may advantageously be metered so as to flow to various sections of the roller at different rates than the others in order to vary the painting effect of the operation of the roller. A motor is also provided for driving the roller at a controlled rotational rate in accordance with the pressure of the paint which is supplied. Both the motor and the pressure supply of paint may be varied in order to vary the application amounts. The motor may be a simple electric motor for driving the roller or a fluid motor which is operated by the flow of the paint therethrough to effect the rotation of the roller.

With the arrangement of the invention it is possible to apply paint at a uniform rate and with much less effort then heretofore. It is not necessary to replenish the paint supply to the roller since the pump in the support means for the roller supplies the paint under a predetermined pressure at all times. In addition it is not necessary to press the roller so that it rotates on the surface receiving the application but a drive motor is advantageously provided to move the roller in a smooth operational rate.

In accordance with another embodiment of the invention the paint is actually contained in the handle of the support for the roller and in such an embodiment the paint is poured into one end of the holder when a cap or cover is removed and it remains in this position during operation. The pump contained in the handle has a suction which extends into the reservoir and the paint is supplied to the roller at a controlled pressure amount.

Control of the flow of the paint may advantageously be effected by varying the amount of paint which is returned from the surface of the roller or by varying the speed of the motor driving the pump which supplies the paint to the roller. Similarly the speed of operation of the roller may be changed as desired during operation in order to vary the amount of paint which is deposited on the surface during a movement of the roller over the surface.

In still another embodiment of the invention the roller support includes a magnet which is adapted to follow over a middle surface to be painted and hold the roller onto the surface during the application.

Accordingly it is an object of the invention to provide a liquid applicator for applying a liquid such as a paint to a receiving surface which includes an applicator member having a porous wall with one side adapted to contact the receiving surface and an opposite side adapted to be wetted with the paint or liquid to be applied and which is enclosed by a pressure chamber and which includes means for supplying the liquid to be applied under pressure to said pressure chamber for forcing through the wall of the applicator to the surface and which advantageously also includes means for moving the surface during the application at a controlled rate.

A further object of the invention is to provide a paint roller construction which comprises a hollow cylindrical roller which has a porous cylindrical applicator surface and which is supported by a support so that it may rotate and which has means for supplying paint to the roller at a continuous rate under pressure for flow through the porous surface and which also advantageously includes means for rotating the roller at a controlled rate. A further object of the invention is to provide a paint roller construction and a liquid applicator which are simple in design rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawings and descriptive matter in which there are illustrated preferred embodiments of the invention.

BRIEF DESCRIPTION OF THE DRAWINGS

In the Drawings:

FIG. 1 is a perspective view of a paint roller having a forced paint feed and means for rotating the roller constructed in accordance with the invention;

FIG. 2 is a partial elevational and partial sectional view of the roller shown in FIG. 1;

FIG. 3 is an enlarged partial sectional view of a portion of the switch housing showing the operation of the switch;

FIG. 4 is a top plan view of another embodiment of the switch control mechanism;

FIG. 5 is a side elevational view of the switch mechanism shown in FIG. 3;

FIG. 6 is a section taken through the handle;

FIG. 7 is a front top perspective view of another embodiment of the invention;

FIG. 8 is an enlarged sectional view of the embodiment shown in FIG. 7;

FIG. 9 is a partial elevational and partial axial sectional view of another embodiment of the invention; and FIG. 10 is a partial side elevational view of still another embodiment of the invention.

GENERAL DESCRIPTION OF THE PREFERRED EMBODIMENTS

Referring to the drawings in particular the invention embodied therein in FIGS. 1 to 6 comprises a liquid applicator in the form of a paint roller generally designated 10 which includes a cylindrical roller 12 having an exterior cylindrical surface 14 which is porous for the flow of a liquid to be applied to a surface therethrough. As best seen in FIG. 2 the outer porous surface 14 is mounted over a cylindrical core 16 which has a closure 18 at one end and an end wall 20 at an opposite end which encloses a pressure space 22 interiorly of the porous applicator wall 14 and the porous wall 16.

In accordance with the invention the roller 12 is supported for rotation on support means 23 which includes a handle portion 24 and a rotational support portion 26. The handle portion 24 is connected through a tubular part 28 to the rotational support portion 26 which connects through a journal fitting 30 of the end closure 20 of the roller 12.

In the embodiment illustrated three separate supply passages for the paint 32, 34 and 36 connect from a common paint supply line 38 and pass through an outer tubular covering 42 within the section 28 to the section 26 and through to the fitting 30. These three separate supply conduits connect individual supply conduits 32', 34' and 36' inside the paint roller 12 and they have discharge openings which discharge into a radial space between the interior cylinder 16 and the roller transfer surface 14. This annular space 22 is thus maintained under pressure supplied from a pump 40 which is mounted on a paint can cover cap 42. The pump 40 takes suction through a suction line 44 which is dipped into an ordinary paint can 46 and which is closed by the cover fitting 42. The paint is discharge by the pump 40 through the discharge conduit line 38 where it branches to the conduits 32, 34 and 36 and flows through the conduits 32', 34' and 36' to the various sections of the pressure space 22 located along the length of the interior of the applicator surface 14. Paint may be returned by the build up of pressure if necessary through a return opening 48 which connects through a radial channel 50 of the fitting 30 and connects through a return line 52 for return to the pump. The amount of pressure which is maintained between the interior hollow cylinder 16 and the porous surface 14 may be varied by controlling the rate of return of the paint through the return line or by controlling the speed of operation of the pump 40.

The pump 40 is advantageously driven by a variable speed electric motor which is supplied with electricity through a connecting port 54. The electrical wires are transmitted through a conduit 56 up through the handle 24 and they pass through the handle and the section 28 to a drive motor 58 for driving the roller at a controlled rotational speed. While the motor 58 is shown as being an electric motor having an output shaft 60 which drives through a gear 62 and a gear 64 it may advantageously comprise a fluid motor which is operated by the fluid pressure generated by the pump motor driving the paint to the roller. The gear 64 is carried on the inner cylinder 16 and rotates it along with the outer applicator surface 14 at a rate which is varied in accordance with the thickness of paint to be deposited during each revolution. The handle 24 advantageously includes an on and off button 66 for the roller drive motor and an on and off button 68 for the pump motor 40. The control button 66 may also include a speed variation for the drive motor if desired. In addition the handle contains a control button 70 for distributing the paint flow from the discharge 38 of the pump 40 to each of the three separate lines 32, 34 and 36. For this purpose the control 70 may be positioned in the center position shown in FIG. 5 at which point it has a portion 71 which deflects a control valve pin 76 to open the center conduit 34 or it may be positioned to either the left or to the right of the position shown in FIG. 5 to separately open only the control lines 32 and 36 by depressing valves **76*a* or 76*b* respectively. In addition it may be moved backwardly in an elongated slot 78 defined in the handle to depress all three valves at once to permit flow through each one of them. This brings the camming surface 72 to the dotted line position shown in FIG. 3**.

FIG. 4 shows an alternate embodiment in which the flow rate through the individual conduits is controlled by separate threaded needle valves 80, **80*a* and 80*b* for respective conduits 34, 32, and 36**.

FIGS. 8 and 7 disclose an embodiment wherein the handle 90 is provided with an end portion 92 forming a paint reservoir 94. The reservoir 94 is filled by removing the cap 96 and pouring paint into the reservoir 94 when it is inverted and then securing the cap back in place by threading it onto a bottom handle portion 98. The handle contains a pump and drive motor 100 which includes a pump suction 102 which extends into the bottom of the reservoir 94 into the lower portion of the cap 96. In this embodiment the pump 100 may be driven at a controlled speed to discharge the paint through a discharge conduit 104 at a controlled rate for effecting the best application onto the paint receiving surfaces. Some paint may be returned through a return line 106 back to the reservoir 94 and this line may advantageously have a control valve for regulating the amount of paint which is returned.

FIG. 9 shows an embodiment in which the paint roller generally designated 110 comprises an outer cylindrical part 112 which includes end caps 114 which are rotatably supported on journal portions 116 of an inner cylindrical part 118. The inner cylindrical part 118 forms a closed container and it provides a reservoir 120 for the liquid to be applied. The reservoir is closed by a cap 122 which may also function as a journal support for rotatably supporting this end of the roller. The journal part 116 carries a driven gear 124 and it is supported on support means 126. The support means 126 advantageously includes a support handle 128 which may be affixed to or which carries a drive motor 130. The drive motor 130 has a shaft connected to a drive pinion 132 which drives the gear 124. The support means also provides means for rotatably supporting the inner cylindrical container 118. In this embodiment the pump 116 has a suction 134 which is disposed at the lowermost portion of the interior 120 of the inner cylinder 118 so that the paint in this cylinder will be picked up during operation by the pump. The pump 116 discharges through a plurality of conduits 140, 142 and 144 to various annular sections of the periphery of the inner container 118 into one or more pressurized spaces 146, 148 and 150 located around the periphery of the inner cylinder 118 and between it and the outer cylinder 113. The outer cylinder 113 also carries a porous application surface 152 which is adapted to bear against the surface to be coated.

FIG. 10 is a modification of FIG. 9 and includes a paint roller generally designated 110' which is supported on a support arm 128 for rotation. The support arm carries a drive motor 130' for driving a pinion 132' and to drive a gear 134' which is affixed to an outer cylinder of the paint roller 110'. The support arm 128 also supports a magnet 160 which advantageously is attracted to a metal part to be coated. The magnet 160 holds the roller against the surface to be coated during the application.

While specific embodiments of the invention have been shown and described in detail to illustrate the application of the principles of the invention, it will be understood that the invention may be embodied otherwise without departing from such principles.

What is claimed is:

1. A liquid applicator for applying a liquid such as a paint to a receiving surface, comprising a handle support having a rotational support portion, a hollow cylindrical roller having a porous cylindrical outer surface rotatably supported on said rotational support portion of said handle support, a plurality of conduits defined through said handle support and said rotational support and connected into the interior of said cylindrical roller at axially spaced locations therein, means mounted on said handle support for selectively controlling the rate of flow through each of said conduits, a pump connected to said conduits and to said handle support for supplying a liquid through said conduits and into said cylindrical roller for passage through the porous surface thereof, and a motor carried by said handle support and connected to said hollow cylindrical roller to rotate said porous surface at a predetermined speed.

2. A paint roller construction, comprising a hollow cylindrical roller having a porous cylindrical applicator surface, support means for supporting said cylindrical surface for rotation including a handle portion of a size to be held in a person's hand, paint supply means associated with said support means including a plurality of conduits extending through said handle portion into said roller for supplying paint under pressure to the interior of said cylindrical applicator surface at axially spaced locations therein, a paint supply pump connected to said handle portion for supplying paint under pressure for flow through said conduits to said porous surface at a predetermined application rate, and means in said handle portion for controlling the rate of flow in each of said conduits, said support means comprising a handle support, a drive motor mounted on said handle support and connected to said cylindrical roller to rotate said roller at a predetermined speed.

3. A paint roller construction according to claim 2, wherein said handle portion is hollow, said conduits being connected to said roller and to a common conduit line extending downwardly from said handle, said paint supply pump being connected to said conduit line and having a suction adapted to be positioned in a paint supply.

4. A paint roller construction according to claim 3, including a paint lid secured to said pump and being of a size to close an ordinary paint container and being placeable on the paint container to position the suction of said pump in the container.

5. A paint roller construction according to claim 2, wherein said conduit extending through said handle includes at least three separate conduit portions connected into said roller at various locations along its axial length and means for controlling the rate of flow through each of said portions.

6. Liquid applicator for applying liquid such as paint to a receiving surface comprising a handle structure including a tubular roller support portion defining a liquid flow conduit, a hand gripping portion, and a liquid supply conduit having one end with at least one conduit portion to connect it to said flow conduit, and an opposite end adapted to be connected to a supply of liquid and having at least a portion between said ends engaged and supported by said handle portion, a pump connected to said liquid supply conduit for pumping liquid through said liquid supply conduit and said liquid flow conduit, a control for said pump connected to said pump for turning it on and off and mounted on said handle portion, an applicator roller mounted on said tubular roller support portion and having a porous roll with one side which is adapted to contact the receiving surface and an opposite side adapted to be wetted with liquid, at least one liquid passage connected between said liquid flow conduit and said roller opposite side for wetting at least a portion of said roller opposite side, and roller drive means mounted on said handle connected to said roller to drive said roller at a selected speed, and a motor control mounted on said hand gripping portion connected to said motor for controlling said motor.

7. A liquid applicator according to claim 6, wherein said hand gripping portion includes a liquid supply reservoir therein, said opposite end of said liquid supply conduit being engaged in said reservoir.

8. A liquid applicator according to claim 7, wherein said pump is mounted in said handle gripping portion.

9. A liquid applicator for applying a liquid such as a paint to a receiving surface, comprising a handle support having a rotational support portion, a hollow cylindrical roller having a porous cylindrical outer surface rotatably supported on said rotational support portion of said handle support, at least one conduit extending through at least a portion of said handle support and said rotational support and connected into the interior of said cylindrical roller, a pump connected to said conduit and to said handle support for supplying a liquid through said conduit and into said cylindrical roller for passage through the porous surface thereof, and a motor connected to said handle support and connected to said hollow cylindrical roller to rotate said porous surface at a predetermined speed, and control means on said handle support connected to said motor and said pump to regulate them.

10. A paint roller construction, comprising a hollow, cylindrical roller having a porous cylindrical applicator surface, support means for supporting said cylindrical surface for rotation including a handle portion of a size to be held in a person's hand, paint supply means associated with said support means including a conduit extending through a part of said handle portion and into said roller for supplying paint under pressure to the interior of said cylindrical applicator surface, a drive motor on said support means connected to said roller to rotate it, a paint supply pump connected to said handle portion for supplying paint under pressure for flow through said conduit to said porous surface at a predetermined application rate, and control means on said handle portion connected to said pump and said drive motor to operate them.

11. A paint roller construction according to claim 10, wherein said roller defines a hollow interior paint pressure space into which the paint is directed, said paint supply pump being mounted on said conduit and having a suction adpated to be connected to a paint supply.

12. A paint roller construction according to claim 11, wherein said conduit includes a plurality of separate conduits for separately distributing paint to said roller at spaced locations along its length, and including means for selectively regulating the flow of paint in said conduits and for regulating the speed of rotation of said roller.

13. A paint roller construction according to claim 11, wherein said conduit includes a flexible portion depending from said handle, said pump means comprising a pump connected to the lower portion of said flexible portion and having an elongated suction adapted to be positioned in a paint can.

14. A paint roller construction according to claim 13, including a paint can cover secured to said pump, said pump having its suction conduit extending through said paint can cover so that when said cover is placed on a paint can the suction is positioned in the contents of the paint can.

15. A paint roller construction according to claim 10, wherein said paint supply means includes a container connected to said handle portion, said pump being mounted on said handle portion and having a suction engaged in said container for supplying paint through said support to said roller.

16. A paint roller construction according to claim 10, wherein said pump is mounted on said roller and has a suction in said roller, said roller having a hollow interior part forming a paint container, said pump discharging out of said paint container into the space between said paint container and said porous cylindrical applicator surface.

17. A paint roller construction, comprising a hollow cylindrical roller having a porous cylindrical applicator surface, support means for supporting said cylindrical roller for rotation including a handle of a size to be held in a person's hand, paint supply means associated with said support means including a conduit extending along at least a portion of said handle and into said roller for supplying paint under pressure to the interior of said cylindrical applicator surface, and a paint supply pump connected to said handle for supplying paint under pressure for flow through said conduit to said porous surface at a predetermined application rate, said support means also comprising a drive motor connected to said handle and connected to said cylindrical roller to rotate said roller at a predetermined speed, and control means on said handle portion connected to said pump and said drive motor to operate them.

18. A paint roller construction according to claim 17, wherein said handle portion has a hollow end portion with a paint reservoir defined therein comprising said present supply means, a cover closing the hollow end portion of said paint reservoir to which the paint may be replenished.

19. A paint roller construction according to claim 17, wherein said conduit includes a plurality of separate conduit portions for separately distributing paint to said roller at spaced locations along its length.

20. A paint roller construction according to claim 17, including means for regulating the flow of paint in said conduit and said control means including means for regulating the speed of rotation of said roller.

21. A paint roller construction according to claim 17, wherein said handle portion includes a hollow portion containing a paint supply, said pump being in said handle having a suction in said paint supply.

22. A paint roller construction according to claim 17, including a hollow cylinder located within said hollow cylindrical roller and having an end portion forming a journal on which said cylindrical roller is rotatable, said hollow cylinder portion comprising a container for paint, said pump having a suction in said container and having a discharge connected to the space between said container and said roller.

23. A paint roller according to claim 17, including magnetic means associated with said roller for holding said roller to a metal surface.

24. A paint roller construction, comprising a hollow cylindrical roller having a porous cylindrical outer surface, a support handle having a bearing support connected to said roller for rotatably supporting said roller on said support handle, a paint conduit extending through said handle and said bearing support and into the interior of said roller, pump means connected to said conduit for pumping paint therethrough into said roller for passage through said porous outer surface onto the surface to be coated, motor means carried by said handle to rotate said roller and control means on said support handle and connected to said pump means and said motor means for controlling said pump means and said motor means.

* * * * *